US006431671B2

(12) United States Patent
Matsumoto

(10) Patent No.: US 6,431,671 B2
(45) Date of Patent: Aug. 13, 2002

(54) INK JET RECORDING METHOD AND APPARATUS

(75) Inventor: Nobuo Matsumoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/785,472

(22) Filed: Feb. 20, 2001

(30) Foreign Application Priority Data

Feb. 18, 2000 (JP) ..... 2000-041077

(51) Int. Cl.[7] ..... B41J 2/195
(52) U.S. Cl. ..... 347/7
(58) Field of Search ..... 347/7, 6, 20, 5, 347/1, 68, 95, 48, 98; 73/861; 346/139 R

(56) References Cited

U.S. PATENT DOCUMENTS

| | | | |
|---|---|---|---|
| 4,109,282 | A | 8/1978 | Robertson et al. |
| 4,614,953 | A | 9/1986 | Lapeyre |
| 5,371,529 | A | 12/1994 | Eguchi et al. |

FOREIGN PATENT DOCUMENTS

| | | |
|---|---|---|
| JP | 3-207664 | 9/1991 |
| JP | 5-201024 | 8/1993 |
| JP | 7-125259 | 5/1995 |
| JP | 9-156131 | 6/1997 |
| JP | 10-264372 | 10/1998 |

*Primary Examiner*—Raquel Yvette Gordon
(74) *Attorney, Agent, or Firm*—Sughrue Mion, PLLC

(57) ABSTRACT

An ink jet recording method and apparatus for changing a mixture proportion of a plurality of types of ink based on an image signal to produce an ink fluid having a predetermine density and/or color, and jetting this fluid to an image receiving medium to form an image. A plurality of types of ink, at least one of which is an image non-forming ink for substantially forming no image after drying out, are mixed before a plurality of ink ejection ports to produce the ink liquid while changing a mixture proportion of the inks based on an image signal. The obtained ink liquid is ejected by an ink droplet ejecting means disposed in the respective ink ejection ports and a constant amount of ink droplets are jetted to the image receiving medium. At least two of the ink droplet ejecting means are simultaneously driven by a common ejection driver. Accordingly, the number of ejection drivers can be reduced, and an apparatus constitution can be simplified. Alternatively, a common ink droplet ejecting means is used for the adjacent ink ejection ports to eject the ink droplets. This also realizes a simple structure of the ink jet head.

18 Claims, 7 Drawing Sheets

INK JET RECORDING METHOD AND APPARATUS

FIELD OF THE INVENTION

The present invention relates to an ink jet recording method and apparatus for changing a mixture proportion of a plurality of types of ink based on an image signal to produce a fluid having a predetermined density and/or a predetermined color, and jetting this fluid to an image receiving medium to form an image.

BACKGROUND OF THE INVENTION

U.S. Pat. No. 4,109,282 (which will hereinafter be referred to as a prior art reference 1) discloses a printer having a structure such that a valve called a flap valve is disposed in a flow channel for leading two types of liquid, i.e., clear ink and black ink onto a substrate for forming an image. The flow channel for each ink is opened/closed by displacing this valve so that the two types of liquid are mixed in a desired density to be transferred onto the substrate. This enables printout of an image having the gray scale information which is the same as that of the image information displayed on a TV screen. In this reference, it is disclosed that a voltage is applied between the flap valve and an electrode disposed on a surface opposite to the flap valve and the valve itself is mechanically deformed by the electrostatic attracting force to cause displacement of the valve. Furthermore, the ink is absorbed in paper by a capillary phenomenon between fibers of the print paper.

U.S. Pat. No. 4,614,953 (which will hereinafter be referred to as a prior art reference 2) discloses a printer head apparatus by which only a desired amount of multiple types of ink having different colors and solvent is led to a third chamber to be mixed therein. In this reference, it is disclosed that a chamber and a diaphragm-type piezoelectric effect device attached to this chamber are used as means for check-weighing a desired amount of ink and a pressure pulse obtained by driving this piezoelectric device is utilized.

Unexamined Japanese Patent Publication (KOKAI) No. 201024/1993 (which will hereinafter be referred to as a prior art reference 3) discloses an ink jet print head including: a liquid chamber in which a carrier liquid is filled; ink jet driving means disposed in the liquid chamber; a nozzle communicating with the liquid chamber; and a mixing portion for mixing ink to the carrier liquid in this nozzle. In this reference, it is also disclosed that adjusting means for adjusting an amount of mixture of ink to a desired value is provided.

Similarly, Unexamined Japanese Patent Publication (KOKAI) No. 125259/1995 (which will hereinafter be referred to as a prior art reference 4) discloses an ink jet recording head including: first and second supplying means for supplying types of ink having first and second densities, respectively; and controlling means for controlling an amount of supply of the second ink by the second supplying means so that a desired ink density can be obtained.

In this reference 4, employment of a micro-pump which has an exclusive heating device and is driven by its heat energy is disclosed as the controlling means. As this micro-pump, there is disclosed an example such that the heat energy is generated by the heating device and a pressure obtained by nucleate boiling caused due to the heat energy is used to drive, for example, a piston-type valve or a cantilever-like valve. Furthermore, this reference 4 describes that an inflow of ink can be effectively controlled in an area where the inflow is particularly small by adopting an actuator consisting of shape memory alloy to this valve.

Unexamined Japanese Patent Publication (KOKAI) No. 207664/1991 (which will hereinafter be referred to as a prior art reference 5) discloses a structure which is similar to that in the prior art reference 2 but which does not use a third chamber for mixing a plurality of types of ink.

Unexamined Japanese Patent Publication (KOKAI) No. 156131/1997 (which will hereinafter be referred to as a prior art reference 6) discloses an ink jet printer comprising a plurality of printer heads for forming an image having multiple colors based on image data. Ink and diluent are mixed at a predetermined mixture proportion to obtain diluted ink which is jetted from a nozzle so that a recording image is formed on a recording medium. The ink jet printer ejects the diluent from at least one printer head out of the multiple printer heads when all-white image data, that is, data representing that amount of mixture of ink is too small to realize a clear printing density, is input. As a result, a rapid change in tone (a tone jump) is prevented and the additional consumption of the diluent is suppressed to improve drying characteristics.

Unexamined Japanese Patent Publication (KOKAI) No. 264372/1998 (which will hereinafter be referred to as a prior art reference 7) discloses employment of a plurality of line heads in which ink ejection nozzles are linearly aligned. In this example, when the respective line heads are biased and arranged in a direction for feeding print paper and positions of nozzles in the respective line heads are biased relatively to a width direction of the print paper, pixel density can be enhanced. Furthermore, ink having a single color is ejected from each nozzle, and ink droplets having different colors are combined by ejecting ink having different colors in accordance with the line heads, thereby representing predetermined colors on the print paper.

In the respective prior arts disclosed in the prior art references 1 to 6, the different types of ink are mixed in advance to be then ejected, and an amount of supply of at least one type of ink among the multiple types of ink to be mixed is controlled. Therefore, a quantity of flow of ink having a desired density or color after mixing, i.e., a volumetric flow rate per unit time varies in accordance with a change in density or color. It has been revealed that, when the volumetric flow rate (which is also referred to as a flow rate hereinafter) per unit time of the ink fluid after mixing fluctuates in accordance with a change in ratio of mixture due to density or color in this manner, the quality of a finally-formed image is prominently deteriorated.

That is, in the image forming technique adopting the conventional ink jet mode described above, a volume of droplets formed by one ejecting operation (the ejection volume) is substantially constant, whereas a liquid flow rate of the mixed ink which is newly successively supplied to an ejection port (a jet generating portion) fluctuates. For example, when a supplied flow rate of the mixed ink is large, the supplied amount of the ink exceeds a quantity of droplets which can be ejected by one ejection operation, and the liquid remaining in the ejection port is mixed in the droplets for the next pixel. Further, when a supplied flow rate of the mixed ink is small, a part of the droplets for the next pixel is disadvantageously incorporated. This adversely affects the image quality.

In the prior art disclosed in the prior art reference 7, since one nozzle ejects single-color ink, one pixel is formed by multiple (three or four or more colors) ink droplets. Therefore, it is difficult to enhance pixel density, and another problem is that improvement of the image quality is restricted.

Moreover, any one of the aforementioned conventional ink jet systems includes one ink droplet ejecting means and a driving circuit of the means, i.e., a driver circuit (hereinafter referred to as ejection driver) with respect to one ink ejection port. That is to say, each ink ejection port is separately provided with a heater and a diaphragm for imparting an ink droplet ejection energy to the port, and these components are separately driven by individual driver circuits.

As a result, the ink droplet ejecting means is set to be inoperative with respect to the ink ejection port which does not contribute to image formation even during the image formation, and it is therefore possible to selectively eject only the ink droplets necessary for the image formation. However, for this purpose, it is necessary to dispose the same number of driver circuits as the number of ink ejection ports, and this complicates an apparatus structure.

SUMMARY OF THE INVENTION

The present invention has been accomplished under the circumstances as described above, and a first object thereof is to provide an ink jet recording method of mixing a plurality of ink liquids having different densities and/or colors to prepare the ink liquid having a desired density and/or color and jetting the ink liquid to an image receiving medium to form an image, so that image quality can be enhanced, an apparatus structure is simplified, and productivity can be enhanced. Moreover, a second object of the present invention is to provide an apparatus which is directly used for implementing this method.

According to the present invention, the first object is attained by an ink jet recording method for jetting an ink droplet of an ink liquid to an image receiving medium to form an image, comprising the steps of:

a) mixing a plurality of types of ink to produce the ink liquid before a plurality of ink ejection ports, a mixture proportion of the plurality of types of ink being changed based on an image signal, at least one of said plurality of types of ink being an image non-forming ink for substantially forming no image after drying out; and b) ejecting the ink liquid from the respective ink ejection ports to form the ink droplets having the same volume, and to jet the ink droplets to the image receiving medium to form the image;

wherein ink droplet ejecting means is disposed in the respective ink ejection ports, and wherein at least two of said ink droplet ejecting means are simultaneously driven by a common ejection driver.

In the present invention, since at least one of the plurality of types of ink is the image non-forming ink, the amount of ink droplets ejected or jetted from the ink ejection port can always be managed to be constant. For example, the ink droplets which forms no image may be formed of the image non-forming ink, and the amount of ink droplets can always be managed to be constant. Therefore, the image can be formed while the plurality of ink ejection ports simultaneously eject the ink droplets.

The plurality of ink ejection ports may be divided into groups so that the ink ejection ports included in the same group are not adjacent with each other, and the plurality of ink ejecting means included in the respective groups may be simultaneously driven by the ejection drivers separately disposed for the respective groups. This is suitable for preventing interference among the types of ink which flow through the adjacent ink ejection ports. That is to say, when the ink flows into the adjacent ink ejection ports from a common ink channel, a timing for flowing into the adjacent ink ejection ports from the common ink channel deviates. In this case, two ejection drivers for driving the adjacent ink droplet ejecting means are further preferably set such that driving timing differs.

The first object of the present invention is also attained by an ink jet recording method for jetting an ink droplet of an ink liquid to an image receiving medium to form an image, comprising the steps of:

a) mixing a plurality of types of ink to produce the ink liquid before a plurality of ink ejection ports, a mixture proportion of the plurality of types of ink being changed based on an image signal, at least one of said plurality of types of ink being an image non-forming ink for substantially forming no image after drying out; and b) ejecting the ink liquid from the respective ink ejection ports to form the ink droplets having the same volume, and to jet the ink droplets to the image receiving medium to form the image;

wherein one common ink droplet ejecting means is disposed for at least two or more adjacent ink ejection ports among said plurality of ink ejection ports; and wherein said common ink droplet ejecting means is driven so that a constant amount of the ink droplets are simultaneously ejected from each of said adjacent ink ejection ports and are jetted to the image receiving medium to form the image.

In this case, since the common ink droplet ejecting means is used for the adjacent ink ejection ports to eject the ink droplets, a structure of an ink jet head (recording head) itself is simplified.

A flow rate of the plurality of types of ink (ink flow rate) can be controlled by various methods. For example, an ink supply pressure to each ink channel is kept to be constant, while a sectional area of each ink channel can be changed by a piezoelectric device. In this case, a diaphragm valve facing to the ink channel is opened/closed by the piezoelectric device. The piezoelectric device can be driven by a mechanically natural frequency (resonance frequency) of the device itself, and the time period for driving the device is changed by varying a pulse number of the frequency to control the flow rate. The piezoelectric device can also continuously control its distortion amount (an opening of the diaphragm valve) by an analog signal. In this case, the flow rate is controlled by a voltage of the analog signal.

When controlling all the flow rates of the plurality of types of ink by using the piezoelectric devices, a sum of cross sectional areas of the ink channels controlled by these piezoelectric devices is always set to be constant, and the amount of ink droplets ejected from the ink ejection port can be controlled to be substantially constant. For example, the sum of the pulse number for the time period for driving each piezoelectric device is controlled to be constant, or the total voltage of the analog signals is adjusted to be constant.

The flow rate supplied to each ink channel may be controlled by changing a discharged quantity of an ink feed pump. For example, the ink feed pump is driven by a pulse motor (stepping motor), and the ink flow rate can be controlled by a driving pulse number of the pulse motor. A usable ink feed pump is provided with at least one check valve disposed in the ink channel, a cavity disposed in the vicinity of the check valve, and a movable member for changing a capacity of the cavity. With such construction, the pump can discharge the ink by changing the volumetric capacity of the cavity.

The check valve used in the feed pump may be constituted in a geometrical shape in which a resistance in an ink flow direction is small and a resistance in a reverse direction is large. Such check valve having no movable portion can be produced by utilizing a method of manufacturing an integrated circuit or a printed wiring board or a method of manufacturing a micro-machine. The ink feed pump may be driven by a pulse motor.

When the ink feed pump driven by the pulse motor is provided to each of the plurality of ink channels, the total flow rate of the ink liquid can be controlled to be constant by always maintaining a total driving pulse number of the pulse motor for driving each ink feed pump constant, thereby the amount of ink droplets can be set to be substantially constant. The ink feed pump for use herein is preferably of a volumetric capacity type in which the discharge amount is proportional to a motor rotation amount. For example, a pump of a type such that a flexible tube closely attached to a circular case inner surface is squeezed in a defined direction from an inner periphery side by an eccentric ring, a vane pump, a gear pump, and the like are suitable.

The ink feed pump provided to each ink channel may be formed of the piezoelectric device and check valve. In this case, the piezoelectric device is a diaphragm valve driven by the mechanical resonance frequency inherent to the device. Each piezoelectric device is controlled in such a manner that the sum of pulse numbers (pulse numbers within a given time or a unit time) of the driving frequency of each piezoelectric device always becomes constant. This sets the total ejection volumetric flow rate of ink to be constant, and the amount of ink droplets can be set to be substantially constant.

Instead of the plurality of types of ink, a microcapsule dispersion liquid can be used in which some reactive materials out of a plurality of materials developing colors by reaction are microcapsulated and microcapsules are dispersed in the other reactive materials. In case that material permeability changes in accordance with a heating amount of a microcapsule wall, the heating amount of the dispersion liquid can be changed based on an image signal to change density and/or color based on the image signal.

After the dispersion liquid is allowed to develop the density and/or color based on the image signal, subsequent density change reaction and/or color development reaction (hereinafter referred to simply as color development reaction) is preferably restricted. For this purpose, for example, the dispersion liquid is irradiated with ultraviolet rays or other electromagnetic waves to decompose at least one type of reactive material, so that the reactive material may be changed to a light-color decomposed material having no coupling ability. In this case, the density or the color can be prevented from changing, even if the microcapsules are ruptured by impact, heat, and the like applied after image recording.

The second object of the present invention is attained by an ink jet recording apparatus for jetting an ink droplet of an ink liquid to an image receiving medium to form an image, said ink liquid comprising an image non-forming ink and an image forming ink, said apparatus comprising:

- a plurality of ink ejection ports for ejecting said ink droplet to the image receiving medium;
- first ink supply means for supplying the image non-forming ink to the respective ink ejection ports;
- second ink supply means for supplying the image forming ink to the respective ink ejection ports;
- a controller for controlling said first and second ink supply means in such a manner that a total amount of the image non-forming and image forming inks supplied to the respective ink ejection ports becomes constant and a mixture proportion of the image non-forming and image forming inks are changed based on an image signal;
- ink droplet ejecting means separately disposed for the respective ink ejection ports; and
- a common ejection driver for simultaneously driving the plurality of ink droplet ejecting means to simultaneously eject the ink liquids from the respective ink ejection ports to form the ink droplets having the same volume so that the ink droplets are jetted to the image receiving medium.

The plurality of ink ejection ports can be arranged in a direction completely or substantially crossing at right angles to a relative moving direction of the ink ejection ports and image receiving medium.

A plurality of adjacent ink ejection ports may be regarded as one group, and the ink droplet ejecting means for simultaneously ejecting the ink droplets from the ink ejection ports included in each group may be disposed for each group. In this case, not only the number of ejection drivers but also the number of ink droplet ejecting means can be reduced, and the structure of the ink jet head (recording head) is also simplified.

The ink droplet ejecting means can be formed by a heater for subjecting the ink liquid to nucleate boiling to eject the ink, a piezoelectric device, or a diaphragm driven by an electrostatic attraction force or an electrostatic repulsive force.

Instead of the plurality of types of ink, the microcapsule dispersion liquid can be used in which some reactive materials out of a plurality of materials developing colors by reaction are microcapsulated and microcapsules are dispersed in the other reactive materials.

In this case, when the material permeability of the wall of the microcapsule is changed by the heat of the heater, the density and/or color can be changed based on the image signal. Moreover, the liquid can be jetted to the image receiving medium by the ink droplet ejecting means formed of the diaphragm. Additionally, after the color development or density change by the heater, at least one type of reactive material may be decomposed to prevent unnecessary color development. For this purpose, an electromagnetic wave source (ultraviolet lamp or the like) may be disposed.

DESCRIPTION OF THE PREFERRED EMBODIMENTS

First Embodiment

Figure 1:
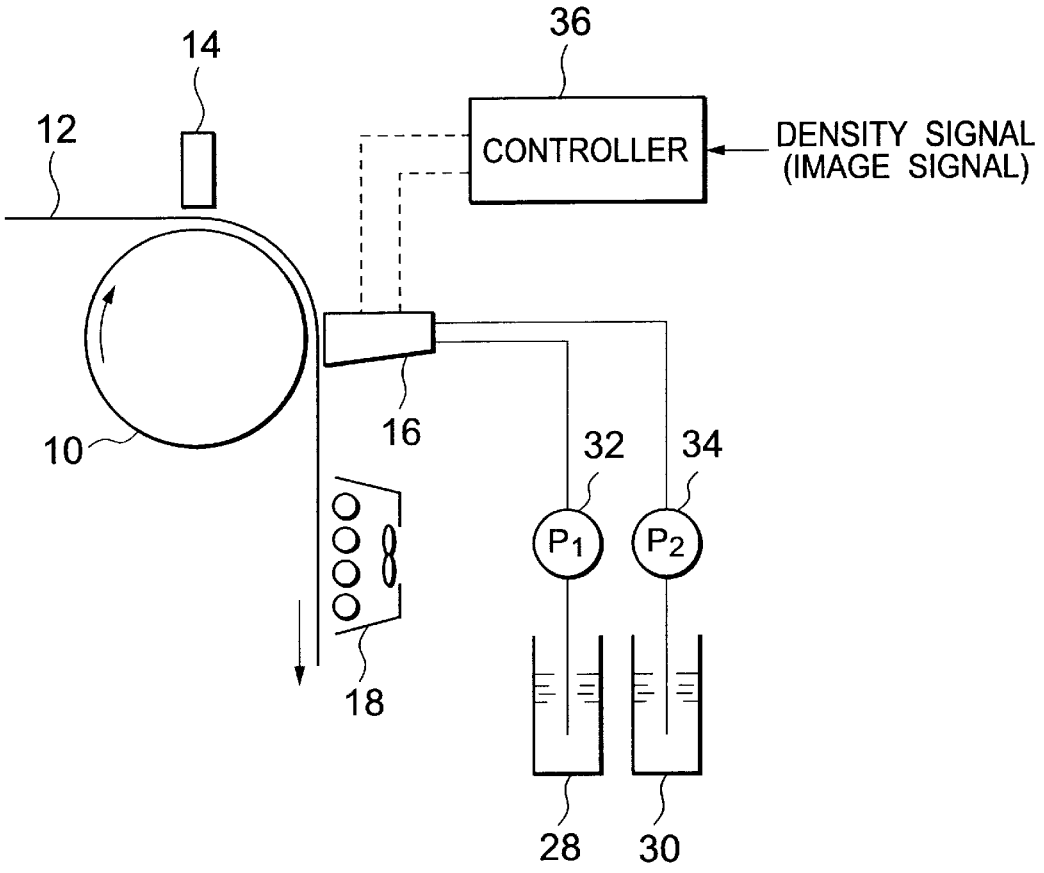
FIG. 1 is a view showing the concept of an image forming apparatus according to a first embodiment of the present invention.

An embodiment is described hereinafter with references to FIGS. 1–4. In FIG. 1, reference numeral 10 designates a platen and 12 denotes a print paper as an image receiving medium wound around the platen 10. The print paper 12 is fed in a direction of an arrowhead at a fixed speed by shown clockwise rotation of the platen 10.

Reference numeral 14 represents an undercoating section for applying a transparent undercoating liquid onto the print paper 12 in order to enhance the adherability of ink and improve image quality. Reference numeral 16 designates an ink jet head (recording head) for forming an image on the print paper 12. First ink and second ink are mixed or combined in the ink jet head 16 and led to the print paper 12. Reference numeral 18 denotes a heater for heating the print paper 12 on which the image has been formed by the ink jet head 16 so that the ink is dried out.

Figure 2:
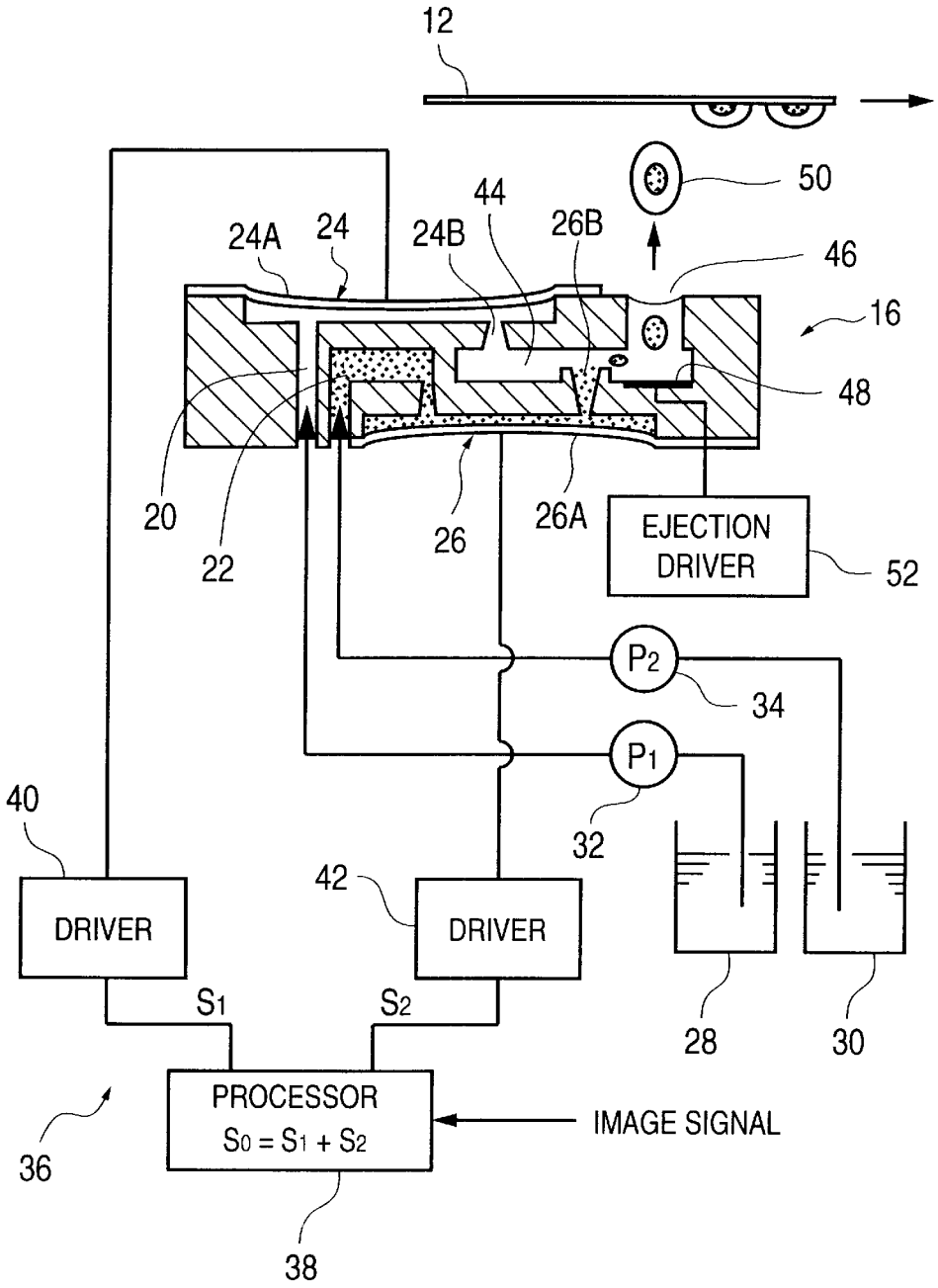
FIG. 2 is an enlarged cross-sectional view of an ink jet recording head used in the image forming apparatus of FIG. 1.

As shown in FIG. 2, the ink jet head 16 includes: a first ink channel 20; a second ink channel 22; and flow control valves 24 and 26 as ink flow rate controlling means for changing channel cross section areas of the respective channels 20 and 22. The first ink is an image non-forming ink, i.e., an ink which becomes transparent and colorless when dried out. The first ink contains a decoloration preventing agent such as antioxidant or ultraviolet ray absorber. The second ink is an image forming ink for finally forming an image, for example, a black ink.

The first and second inks are respectively contained in ink tanks 28 and 30, and fed to the first and second ink channels 20 and 22 with a fixed pressure from the ink tanks 28 and 30 by ink feed pumps 32 and 34 as ink supply means. As the pumps 32 and 34 used in this example, those having a structure in which a pressure adjusting valve is disposed on an ink discharge side (the side of the outlet port of the pump) to maintain an ejection pressure to be constant are suitable.

Flow control valves 24, 26 include, for example, diaphragms 24A, 26A which move into/from the ink channels 20, 22 by distortion of piezoelectric devices, respectively. These piezoelectric devices are controlled by a controller 36 (FIG. 1) in such a manner that a total supply amount $S_0$ of the first and second inks supplied from the respective-ink channels 20, 22 is always constant.

The controller 36 includes a processor 38 and drivers 40, 42 as shown in FIG. 2. The processor 38 calculates a mixture proportion of the first and second inks ($S_1/S_2$) based on a density signal (image signal). The supply amounts $S_1$ and $S_2$ of the first and second inks are determined so that the sum ($S_1+S_2$) becomes a fixed amount $S_0$. The drivers 40 and 42 drive the piezoelectric devices in order that the supply amounts from the respective channels 20 and 22 become $S_1$ and $S_2$.

For example, the piezoelectric devices are driven by a pulse having a mechanical resonance frequency inherent to the device, and the pulse number controls a number of times of opening/closing the diaphragms, thereby controlling flow rates $S_1$ and $S_2$. In this case, if channel resistance of the ink channels 20 and 22, ink feed pressure, conditions for opening/closing the diaphragms 24A and 26A, and the like are satisfied, a total flow rate $S_0=S_1+S_2$ can be managed to be constant by controlling a sum of the pulse number for driving the piezoelectric devices to become a fixed value.

Additionally, in the present embodiment, the flow control valves 24, 26 include cavities 24B, 26B whose capacities are changed by displacement of the diaphragms 24A, 26A. Moreover, geometric shapes of respective sections of these cavities 24B, 26B are set in such a manner that inflow resistance of the first and second inks flowing into these cavities 24B, 26B through ink feed pumps 32, 34 becomes larger than outflow resistance of the inks flowing into a mixing chamber 44 through these cavities 24B, 26B, respectively.

Furthermore, the ink ejection port 26B, through which the second ink flows into the mixing chamber 44, projects into the mixing chamber 44 from the inner wall surface of the mixing chamber 44. Therefore, the second or black ink is ejected into a flow of clear first ink without adhering to the inner wall of the mixing chamber 44, and led to an ink ejection port 46 in a wrapped state in the first ink. An ink droplet 50 is ejected from the ink ejection port 46 by a heater 48 as ink droplet ejecting means, and the ink droplet 50 flies to the print paper 12 to form an image on the print paper 12.

The heater 48 as the ink droplet ejecting means is disposed on the inner surface of the mixing chamber 44 to face to an opening of the ink ejection port 46. Specifically, the heater 48 is positioned on a plane crossing at right angle to an opening direction (ink droplet flying direction) of the ink ejection port 46 which crosses at right angles to a longitudinal direction of the mixing chamber 44. The heater 48 generates heat by an ejection driver 52. By the heat generation, the ink liquid in contact with the heater 48 is heated and subjected to nucleate boiling, and in this case, the ink is ejected as a liquid droplet from the ink ejection port 46 by a pressure generated by volume expansion.

This embodiment is of a so-called roof-shooter type (or a top-shooter type) in which the ink droplet ejection direction is parallel to a direction in which an ejection force is imparted by the heater 48 (the direction vertical to the surface of the heater 48). However, the present invention may be of a so-called side-shooter type in which the ink droplet ejection direction crosses at right angles to the ejection force imparting direction of the ink droplet ejecting means.

Figure 3:
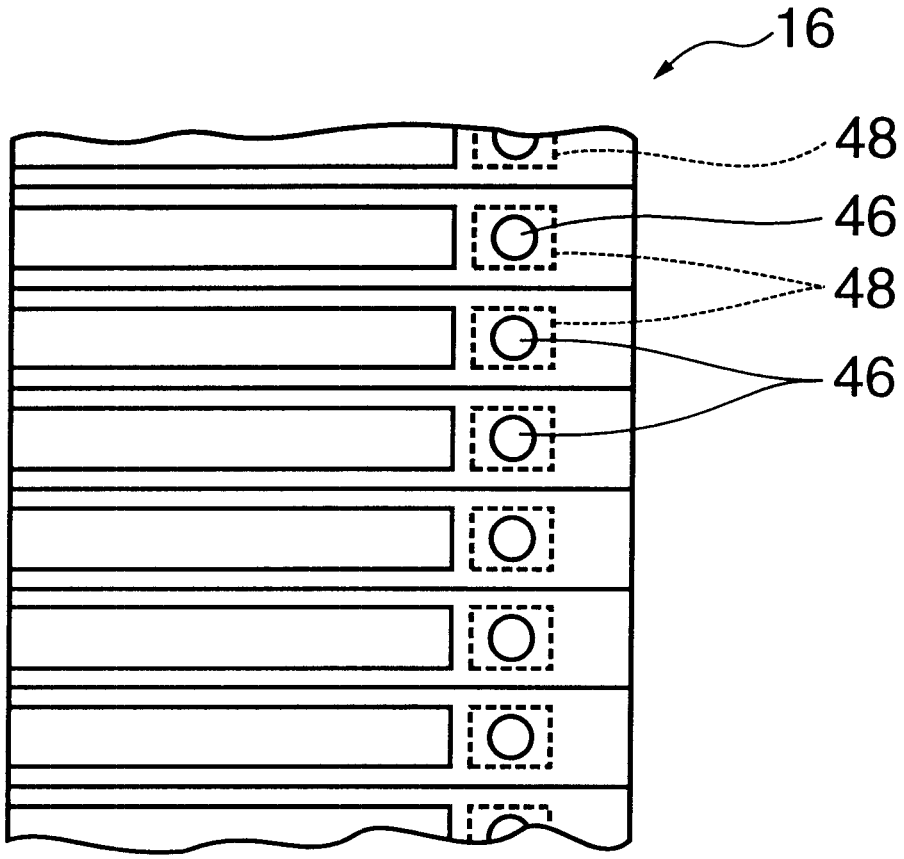
FIG. 3 is a plan view of an ink jet head of FIG. 2.
Figure 4:
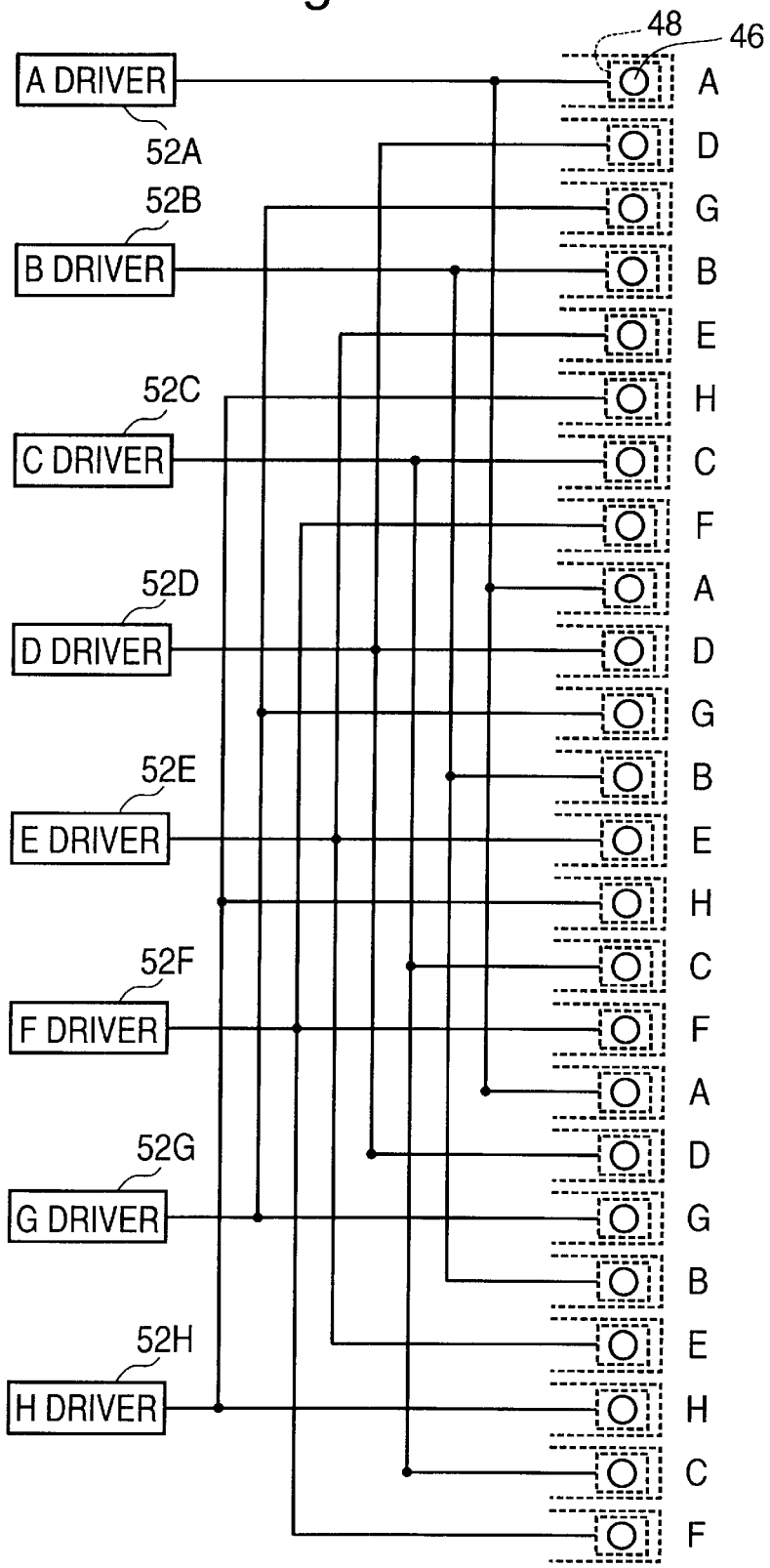
FIG. 4 is a diagram showing a driving system of ink droplet ejecting means.

In the embodiment, as shown in FIG. 3, one heater 48 as the ink droplet ejecting means is disposed for each ink ejection port 46. More specifically, the heater 48 is disposed for each channel (scanning line) connected to each ink ejection port 46 which corresponds to each pixel. A plurality of heaters 48 are simultaneously driven in parallel by the common ejection driver 52 as shown in FIG. 4. This method can be realized for the following reason. The ink droplet 50 ejected from each ink ejection port 46 is constituted of the clear first ink and the image forming second ink. The total amount of the ink droplet can be maintained constant, even if the amount of the image forming second ink is small. In this case, the clear first ink is supplemented to maintain the total amount of the ink droplet constant. Accordingly, all the ink ejection ports 46 can eject substantially the same amount of ink droplets. In the conventional method of ejecting only the image forming ink from the selected ink ejection port based on the image signal, the respective ejection ports require different drivers.

The heaters 48 of the adjacent ink ejection ports 46 are driven by different ejection drivers 52 (52A to 52H). When the adjacent heaters 48 are driven by the different ejection drivers 52 in this manner, a slight timing deviation in the ink flow is generated with respect to the adjacent ink ejection port 46, and the respective channels can be prevented from interfering with each other. In this case, simply by changing driving timings of the ejection drivers 52 of the adjacent channels, the interference can more securely be prevented.

For example, in the embodiment of FIG. 4, the driving timings of ejection drivers 52A, 52G, 52E, 52C of channels A, G, E, C which are not adjacent to one another are matched, and the driving timings of the ejection drivers 52D, 52B, 52H, 52F of channels D, B, H, F are matched. Moreover, the driving timing of the former group (52A, 52G, 52E, 52C) is set not to agree with the driving timing of the latter group (52D, 52B, 52H, 52F).

Second Embodiment

Figure 5:
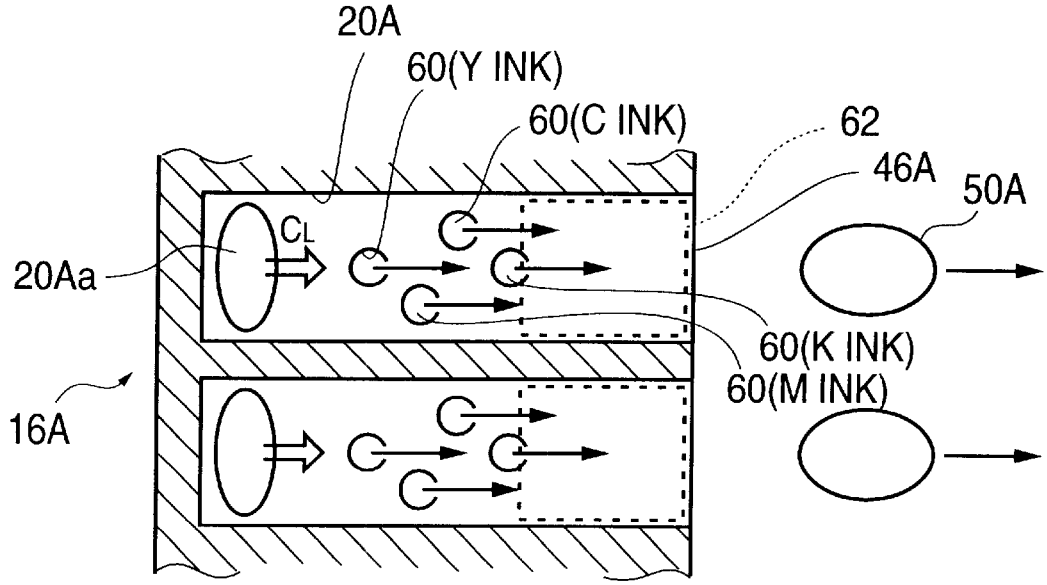
FIG. 5 is a plan view showing the inside of the ink jet head according to a second embodiment.
Figure 6:
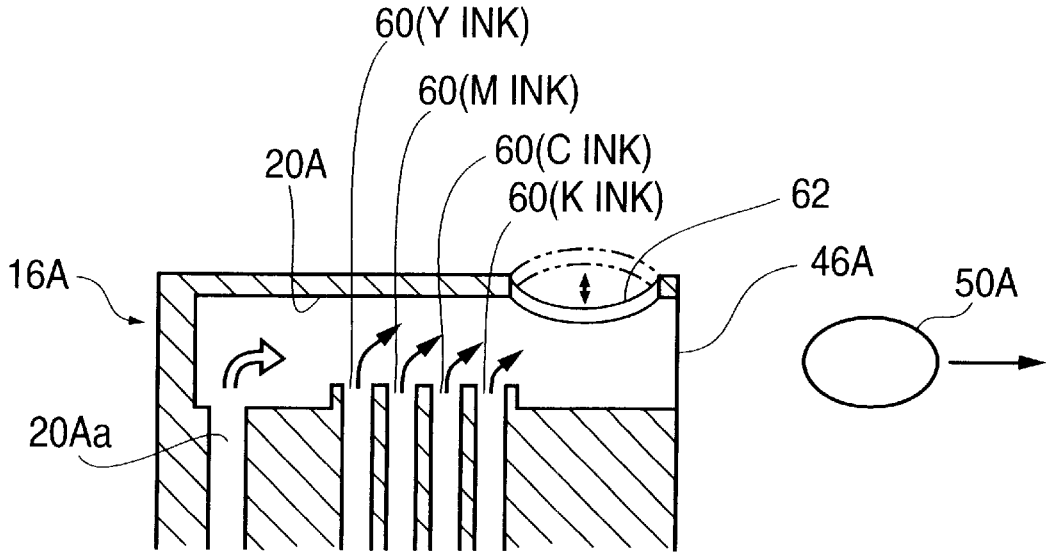
FIG. 6 is a side cross-sectional view of the ink jet head of FIG. 5.

FIG. 5 is a plan view showing the inside of the ink jet head according to a second embodiment, and FIG. 6 is a side cross-sectional view of the ink jet head. In the embodiment, image forming liquids of different colors are ejected or extruded into a common first ink channel 20A of the ink jet head 16A. Specifically, a clear liquid (image non-forming liquid) feed port 20Aa is disposed in one end of the first ink channel 20A, and a laminar flow of clear liquid CL is formed in the first ink channel 20A. Respective inks of yellow (Y), magenta (M), cyan (C) and black (K) are ejected into the clear liquid CL from four ink ejection ports 60 projecting from an inner wall of the first ink channel 20A.

A predetermined amount of a predetermined color of ink controlled based on the image signal is added to the first ink (clear liquid) flowing in the first ink channel 20A from each ink ejection port 60, and led into an ink ejection port 46A. A diaphragm 62 as the ink droplet ejecting means is disposed in a position close to the ink ejection port 46A of the first ink channel 20A. The diaphragm 62 is driven by a piezoelectric device and other appropriate driving means such as an electrostatic attraction force and an electrostatic repulsive force.

The diaphragm 62 is driven by the ejection driver as shown in FIG. 4, and an ink droplet 50A is ejected toward the print paper (not shown) from the ink ejection port 46A in synchronization with the vibration of the diaphragm 62. In the embodiment, a plurality of diaphragms 62 are simultaneously driven in parallel by the common ejection driver.

According to the second embodiment, by controlling ejection amounts of the respective ink based on the image signal, the mixture proportion of the respective inks is changed, and as a result a color image can beformed. The respective inks are ejected into the clear liquid CL and do not adhere to the inner wall of the first ink channel 20A, and therefore image quality is enhanced.

Third Embodiment

Figure 7:
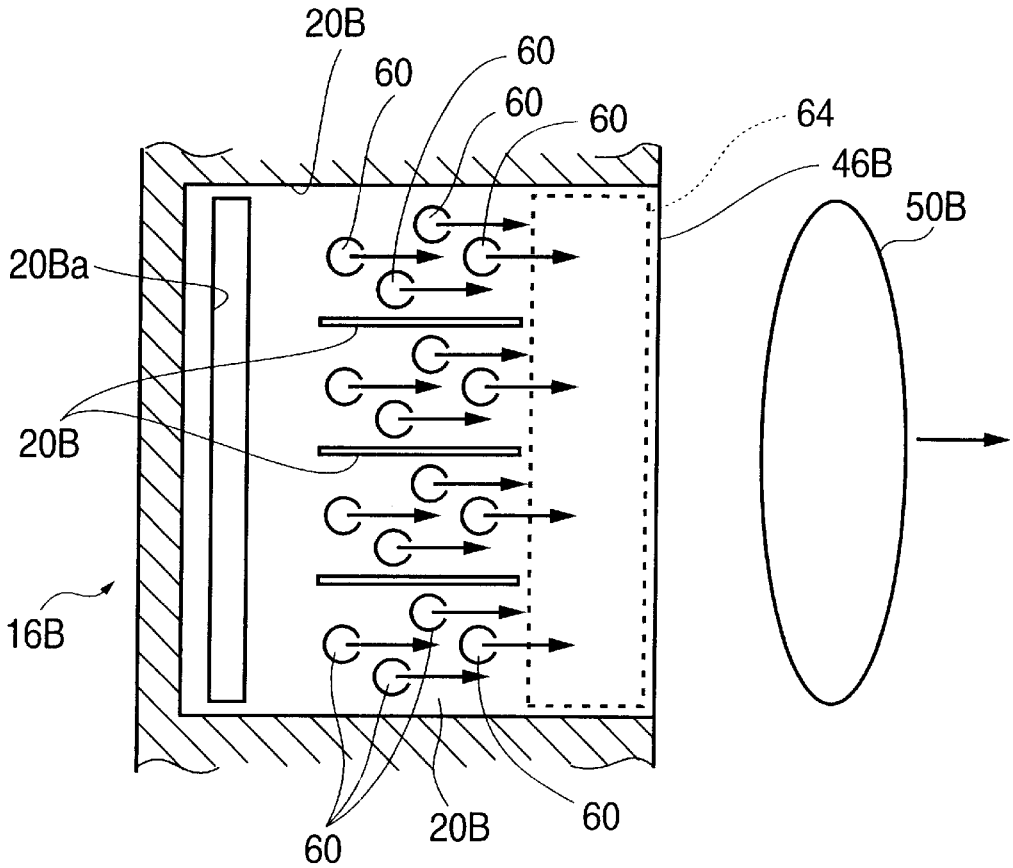
FIG. 7 is a plan cross-sectional view showing the ink jet head according to a third embodiment.
Figure 8:
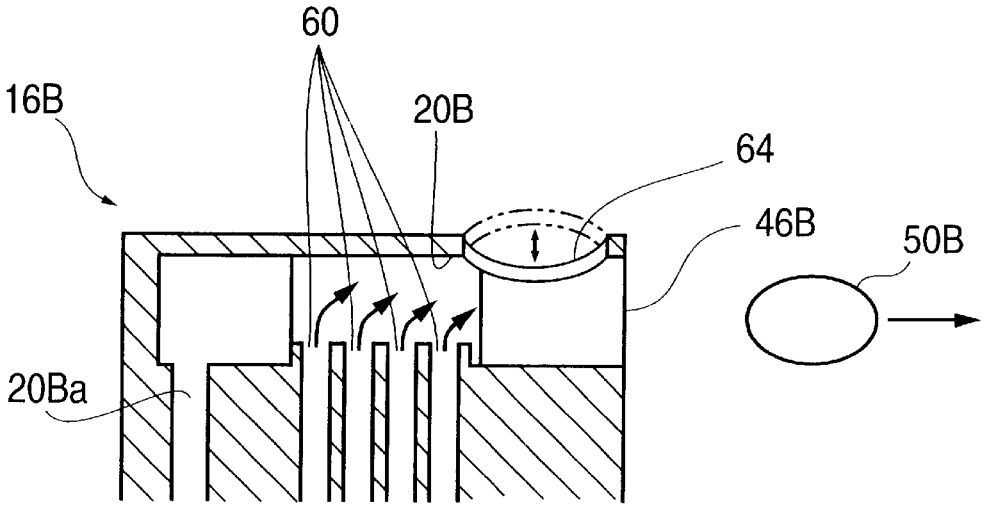
FIG. 8 is a side cross-sectional view of the ink jet head of FIG. 7.

FIG. 7 is a plan view showing the inside of the ink jet head according to a third embodiment, and FIG. 8 is a side cross-sectional view of the ink jet head. For an ink jet head 16B of the present embodiment, one ink droplet ejecting means is used in channels for a plurality of adjacent pixels so that the number of ink droplet ejecting means is largely reduced and the structure of the ink jet head 16B is simplified.

In the ink jet head 16B, adjacent first ink channels 20B for a plurality of pixels are connected to one another on upstream and downstream sides of the ink ejection ports 60. Partition walls for partitioning the ink channels 20B for a plurality of channels are removed except the vicinity of the ink ejection ports 60. Moreover, a first ink ejection port 20Ba is disposed in a slot shape to form a constant-pressure laminar flow of the clear liquid in each ink channel 20B.

Furthermore, a slot-shaped ink ejection port 46B is formed on the downstream side of the respective ink channels 20B. Additionally, an elongated diaphragm 64 crossing the respective ink channels 20B is disposed in the vicinity of the ink ejection port 46B, and this diaphragm 64 is used as the ink droplet ejecting means.

In the third embodiment, the ink whose density and color changes based on the image signal of each pixel is led to the vicinity of the ink ejection port 46B from each ink channel 20B. When the diaphragm 64 is vibrated, the ink led in the vicinity of the ink ejection port 46B forms an ink droplet 50B and is ejected from the ink ejection port 46B. The ink droplet 50B flies toward the print paper. The ink droplet 50B is formed by unifying the ink droplets 50A for the plurality of pixels in FIGS. 5, 6. When a flying distance of the ink droplet 50B is sufficiently shortened, the inks of the respective ink channels 20B can be attached to the print paper without being uniformly mixed or without changing relative positions.

Fourth Embodiment

Figure 9:
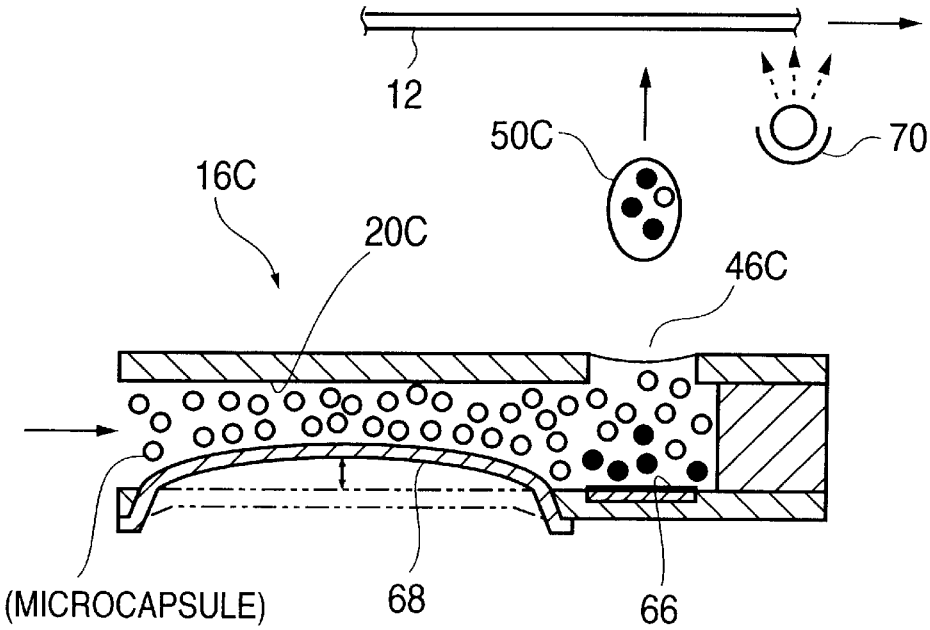
FIG. 9 is a side cross-sectional view of the ink jet head according to a fourth embodiment.

FIG. 9 is a side cross-sectional view of an ink jet head 16C according to a fourth embodiment. In the present embodiment, a microcapsule dispersion liquid is used instead of a plurality of inks. In this case, the microcapsules dispersed in a liquid which is substantially clear after dried out can be used. For example, the microcapsule contains diazonium salt as a core material and is dispersed in the clear liquid containing: a coupler (2-hydroxy-3-anilide naphthenate, and the like) which reacts with diazonium salt; a basic compound (triphenylguanidine, and the like) which promotes a coupling reaction; and a sensitizing agent (phenol compound, and the like). Preferably, main component of the microcapsule wall or membrane is, for example, polyurea urethane, and a refractive index of the microcapsule wall after drying is set to be substantially the same as the refractive index of the dried dispersion liquid.

By an application of heat to the dispersion liquid, the microcapsule wall obtains a sufficiently large material permeability (material permeable ratio). Therefore, the coupler and basic compound are mixed to be melt together with the sensitizing agent. Further, since the glass transition temperature of the microcapsule wall is lowered by an action of the sensitizing agent, the microcapsule wall swells and the wall material permeability (i.e., material permeable amount) increases at the relatively low temperature. As a result, the coupler and basic compound in the clear liquid or diazonium salt in the microcapsule core permeates through the microcapsule wall and contact each other and react to form a dyestuff. That is, color is developed.

Therefore, when the heat modulated by the image signal is applied to the microcapsule dispersion liquid, the density and/or color of the ejected liquid droplet can be changed. When the heating amount of the dispersion liquid is controlled based on the image signal, the ejected liquid having a desired density/color is prepared, and jetted as the liquid droplet to an image receiving medium (e.g., print paper) by liquid droplet ejecting means.

In FIG. 9, reference numeral 20C denotes a channel of the microcapsule dispersion liquid, and a liquid (ink) ejection port 46C is disposed in a direction crossing at right angles to the channel 20C. A heater 66 is disposed opposite to the liquid ejection port 46C on the inner wall of the channel 20C. A heat generation amount of the heater 66 is controlled based on the image signal, and increase/decrease of the heat generation amount results in increase/decrease of the microcapsule material permeability. As a result, the density/color of the ejected liquid is controlled.

Liquid droplet (ink droplet) ejecting means including a diaphragm 68 is disposed on the inner wall of the ejected liquid channel 20C. When the diaphragm 68 is driven to reciprocate and vibrate by the ejection driver (not shown),. the ejected liquid is pressurized, and a liquid droplet 50C is therefore ejected from the liquid ejection port 46C. Since the density/color of the liquid droplet 50C is already adjusted by the heater 66, the liquid droplet 50C can be jetted to the print paper 12 as the image receiving medium to form the image.

Additionally, the ejected liquid after image recording preferably causes no unnecessary color development reaction by pressure, heat, and the like. At least one type of material out of reactive materials contained in the microcapsule dispersion liquid may be decomposed by electromagnetic waves such as ultraviolet rays to stop unnecessary color development reaction. In the present embodiment, an ultraviolet lamp 70 is disposed as an electromagnetic wave source to prevent the unnecessary color development reaction.

According to the present embodiment, it is unnecessary to form a valve for controlling a plurality of ink channels and respective ink flow rates in an ink jet head (recording head). Therefore, a constitution of the ink jet head can remarkably be simplified as compared with the constitution shown in FIGS. 1 to 8.

Fifth Embodiment

Figure 10:
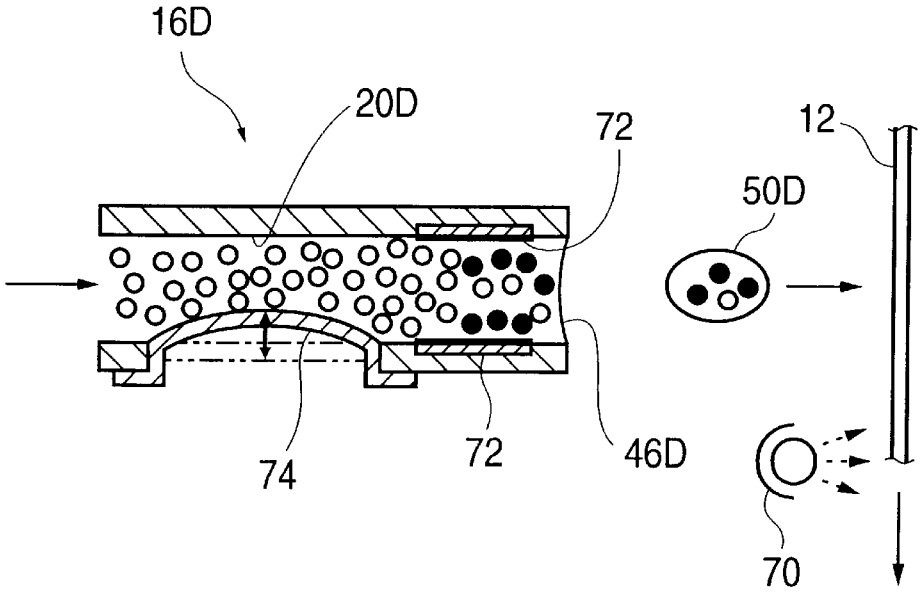
FIG. 10 is a side cross-sectional view of the ink jet head according to a fifth embodiment.

FIG. 10 is a side cross-sectional view of an ink jet head 16D according to a fifth embodiment. The present embodiment is different from the embodiment shown in FIG. 9 in that an opening direction of a liquid ejection port 46D is disposed parallel to an ejected liquid channel 20D.

Specifically, a downstream end of the channel 20D is linearly opened, and this opening is used as the liquid ejection port 46D. Moreover, a pair of heaters 72 are disposed on two opposite wall surfaces of the channel 20D in the vicinity of the liquid ejection port 46D. Reference numeral 74 denotes a diaphragm as the liquid ejecting means.

According to the present embodiment, since the ejected liquid is heated from both sides by the pair of heaters 72, the microcapsule material permeability can quickly and securely be changed. Therefore, an ejected liquid flow speed can be raised to raise an image forming speed. A liquid droplet 50D ejected from the liquid ejection port 46D by the vibration of the diaphragm 74 and attached to the print paper 12 is irradiated with the ultraviolet ray by the ultraviolet lamp 70. The material contained in the liquid droplet 50D, for example, diazonium salt in the microcapsule is decomposed.

In the aforementioned first to fifth embodiments, as the method of ejecting the ink droplet (liquid droplet), a method of vibrating the diaphragm by the piezoelectric device (so-called piezo ink jet method shown in FIGS. 5, 6, 7, 8, 9, 10), and the method of nucleate-boiling the heater (so-called thermal ink jet method shown in FIG. 2) have been described. However, the present invention also includes a method of ejecting the ink droplet (liquid droplet) in another mode. For example, a continuous ink jet mode, an electrostatic attraction ink jet mode, an ultrasonic ink jet mode, and the like can also be applied.

According to the present invention, as described above, since a plurality of ink droplet (liquid droplet) ejecting means are simultaneously driven in parallel by a common ejection driver, the number of ejection drivers can be reduced, and an apparatus constitution can be simplified.

In a case that the ports are divided into groups of non-adjacent ink ejection ports (liquid ejection ports), and the respective groups can be driven by separate ejection drivers. Since the ink droplet (liquid droplet) ejecting means of the adjacent channels are driven by different ejection drivers, an interference among the channels is prevented. Particularly, the ink droplet (liquid droplet) ejecting means of the adjacent channels are set in such a manner that the driving timings of the ejection drivers for driving the respective ejecting means differ from each other. In this case, the interference among the channels can more securely be prevented.

Moreover, according to the present invention, since the ink droplet is ejected from a plurality of adjacent ink ejection ports by the common ink droplet ejecting means, the number of ink droplet ejecting means disposed in the ink jet head can largely be reduced, and the structure of the ink jet head can be simplified.

Instead of a plurality of inks, the microcapsule dispersion liquid can be used in which some of a plurality of materials developing colors by reaction are microcapsulated and dispersed in another reactive material. In this case, the material permeability of the microcapsule wall can be changed based on the image signal to change the density and/or color of the ejected liquid. Therefore, it is possible to remarkably simplify the structure of the ink (liquid) jet head and easily manufacture the head.

In this case, when the material permeability (ratio) of the microcapsule can be changed by heating the microcapsule, the heating amount of the heater can be changed in response to the image signal to easily change the density/color of the ejected liquid. Moreover, when at least one type of reactive material is decomposable by the electromagnetic waves such as ultraviolet rays, and the material is decomposed after changing the density/color in response to the image signal, the material can be prevented from inadvertently developing color after image formation and from deteriorating the image quality.

Moreover, according to the present invention, the ink jet recording apparatus for direct use in implementation of the aforementioned method can be obtained. As the ink droplet ejecting means used herein, a thermal ink jet mode, an ink jet mode for driving the diaphragm by the piezoelectric device, a mode for driving the diaphragm by an electrostatic attraction force or an electrostatic repulsive force, and other various modes can be used.

What is claimed is:

1. An ink jet recording method for jetting an ink droplet of an ink liquid to an image receiving medium to form an image, comprising the steps of:

a) mixing a plurality of types of ink to produce the ink liquid before a plurality of ink ejection ports, a mixture proportion of the plurality of types of ink being changed based on an image signal, at least one of said plurality of types of ink being an image non-forming ink for substantially forming no image after drying out; and b) ejecting the ink liquid from the respective ink ejection ports to form the ink droplets having the same volume, and to jet the ink droplets to the image receiving medium to form the image;

wherein ink droplet ejecting means is disposed to the respective ink ejection ports, and wherein at least two of said ink droplet ejecting means are simultaneously driven by a common ejection driver.

2. The ink jet recording method according to claim 1, wherein said plurality of ink ejection ports are divided into groups so that the ink ejection ports included in the same group are not adjacent to each other; and wherein a plurality of ink droplet ejecting means included in the respective groups are driven by the respective ejection drivers disposed separately for the respective groups.

3. The ink jet recording method according to claim 2, wherein the ejection drivers for driving the respective ink droplet ejecting means of the adjacent ink ejection ports have different driving timings with each other.

4. The ink jet recording method according to claim 1, wherein said plurality of ink ejection ports are arranged in a direction crossing at right angles to a relative moving direction of the ink ejection ports and the image receiving medium.

5. An ink jet recording method for jetting an ink droplet of an ink liquid to an image receiving medium to form an image, comprising the steps of:

a) mixing a plurality of types of ink to produce the ink liquid before a plurality of ink ejection ports, a mixture proportion of the plurality of types of ink being changed based on an image signal, at least one of said plurality of types of ink being an image non-forming ink for substantially forming no image after drying out; and b) ejecting the ink liquid from the respective ink ejection ports to form the ink droplets having the same volume, and to fly the ink droplets to the image receiving medium to form the image;

wherein one common ink droplet ejecting means is disposed for at least two or more adjacent ink ejection ports among said plurality of ink ejection ports; and wherein said common ink droplet ejecting means is driven so that a constant amount of the ink droplets are simultaneously ejected from each of said adjacent ink ejection ports and are jetted to the image receiving medium to form the image.

6. The ink jet recording method according to claim 5, wherein said plurality of ink ejection ports are arranged in a direction crossing at right angles to a relative moving direction of the ink ejection ports and the image receiving medium.

7. An ink jet recording apparatus for jetting an ink droplet of an ink liquid to an image receiving medium to form an image, said ink liquid comprising an image non-forming ink and an image forming ink, said apparatus comprising:

a plurality of ink ejection ports for ejecting said ink droplet to the image receiving medium;

first ink supply means for supplying the image non-forming ink to the respective ink ejection ports;

second ink supply means for supplying the image forming ink to the respective ink ejection ports;

a controller for controlling said first and second ink supply means in such a manner that a total amount of the image non-forming and image forming inks supplied to the respective ink ejection ports becomes constant and a mixture proportion of the image non-forming and image forming inks are changed based on an image signal;

ink droplet ejecting means separately disposed for the respective ink ejection ports; and a common ejection driver for simultaneously driving the plurality of ink droplet ejecting means to simultaneously eject the ink liquids from the respective ink ejection ports to form the ink droplets having the same volume so that the ink droplets are jetted to the image receiving medium.

8. The ink jet recording apparatus according to claim 7, wherein said plurality of ink ejection ports are divided into groups so that the ink ejection ports included in the same group are not adjacent to each other; and wherein a plurality of ink droplet ejecting means included in the respective groups are simultaneously driven by the common ejection drivers which are disposed separately for the respective groups.

9. The ink jet recording apparatus according to claim 8, wherein the ejection drivers for driving the respective ink droplet ejecting means of the adjacent ink ejection ports have different driving timings with each other.

10. The ink jet recording apparatus according to claim 7, wherein said plurality of ink ejection ports are arranged in a direction crossing at right angles to a relative moving direction of the ink ejection ports and the image receiving medium.

11. The ink jet recording apparatus according to claim 7, wherein said ink droplet ejecting means comprises a heater for heating the ink liquid to cause nucleate-boiling and ejecting the ink droplet to the image receiving medium.

12. The ink jet recording apparatus according to claim 7, wherein said ink droplet ejecting means comprises a diaphragm driven by a piezoelectric device.

13. The ink jet recording apparatus according to claim 7, wherein said ink droplet ejecting means comprises a diaphragm driven by an electrostatic attraction force or an electrostatic repulsive force.

14. An ink jet recording apparatus for jetting an ink droplet of an ink liquid to an image receiving medium to form an image, said ink liquid comprising an image non-forming ink and an image forming ink, said apparatus comprising:

a plurality of ink ejection ports for ejecting said ink droplet to the image receiving medium;

first ink supply means for supplying the image non-forming ink to the respective ink ejection ports;

second ink supply means for supplying the image forming ink to the respective ink ejection ports;

a controller for controlling said first and second ink supply means in such a manner that a total amount of the image non-forming and image forming inks supplied to the respective ink ejection ports becomes constant and a mixture proportion of the image non-forming and image forming inks are changed based on an image signal;

one common ink droplet ejecting means, disposed for two or more adjacent ink ejection ports out of said plurality of ink ejection ports, for simultaneously ejecting the ink liquids from the respective ink ejection ports to form the ink droplets having the same volume so that the ink droplets are jetted to the image receiving medium.

15. The ink jet recording apparatus according to claim 14, wherein said plurality of ink ejection ports are arranged in a direction crossing at right angles to a relative moving direction of the ink ejection ports and the image receiving medium.

16. The ink jet recording apparatus according to claim 14, wherein said ink droplet ejecting means comprises a heater for heating the ink liquid to cause nucleate-boiling and ejecting the ink droplet to the image receiving medium.

17. The ink jet recording apparatus according to claim 14, wherein said ink droplet ejecting means comprises a diaphragm driven by a piezoelectric device.

18. The ink jet recording apparatus according to claim 14, wherein said ink droplet ejecting means comprises a diaphragm driven by an electrostatic attraction force or an electrostatic repulsive force.

* * * * *